US006428312B1

(12) United States Patent
Smelcer et al.

(10) Patent No.: US 6,428,312 B1
(45) Date of Patent: Aug. 6, 2002

(54) RESONANCE FREE BURNER

(75) Inventors: Jimmy C. Smelcer, Hermitage; Timothy J. Bodnar, Nashville, both of TN (US)

(73) Assignee: Lochinvar Corporation, Lebanon, TN (US)

( * ) Notice: Subject to any disclaimer, the term of this patent is extended or adjusted under 35 U.S.C. 154(b) by 0 days.

(21) Appl. No.: 09/567,964

(22) Filed: May 10, 2000

(51) Int. Cl.[7] ..... F23D 14/14

(52) U.S. Cl. ..... 431/329; 431/7; 431/114; 431/354

(58) Field of Search ..... 431/329, 328, 431/326, 7, 170, 354, 100, 112, 350; 126/92 AC, 92 R

(56) References Cited

U.S. PATENT DOCUMENTS

| | | | | | |
|---|---|---|---|---|---|
| 1,028,388 | A | * | 6/1912 | Roder | 431/112 |
| 3,122,197 | A | * | 2/1964 | Saponara et al. | 431/329 |
| 3,280,428 | A | * | 10/1966 | Watts, Jr. | 431/329 |
| 3,771,945 | A | | 11/1973 | Teague, Jr. | |
| 3,825,403 | A | * | 7/1974 | Gottschall | 431/329 |
| 4,557,687 | A | | 12/1985 | Schirneker | |
| 4,723,513 | A | | 2/1988 | Vallett et al. | |
| 4,793,800 | A | | 12/1988 | Vallett et al. | |
| 4,869,230 | A | | 9/1989 | Fletcher et al. | |
| 4,919,609 | A | * | 4/1990 | Sarkisian et al. | 431/329 |
| 5,383,445 | A | | 1/1995 | Dixon | |
| 5,417,566 | A | * | 5/1995 | Ishikawa et al. | 431/328 |
| 5,512,250 | A | | 4/1996 | Betta et al. | |
| 5,525,054 | A | | 6/1996 | Nakaura et al. | |
| 5,622,491 | A | | 4/1997 | Van Belle | |
| 5,636,981 | A | | 6/1997 | Lilly | |
| 5,833,450 | A | | 11/1998 | Wunning | |
| 5,836,757 | A | * | 11/1998 | Long et al. | 431/107 |
| 5,899,686 | A | * | 5/1999 | Carbone et al. | 431/328 |
| 5,989,013 | A | | 11/1999 | Gray | |
| 5,993,200 | A | * | 11/1999 | Palmer-Jones | 431/328 |
| 6,149,424 | A | * | 11/2000 | Marrecau et al. | 431/329 |

FOREIGN PATENT DOCUMENTS

| | | | |
|---|---|---|---|
| DE | 40 14217 A1 | * | 11/1990 |
| JP | 62-166212 A | * | 7/1987 |
| JP | 9-170725 A | * | 6/1997 |

OTHER PUBLICATIONS

Catalog of Acotech entitled Metal Fibre Burner—Surface combustion (undated but admitted to be prior art).
"North American Combustion Handbook Third Edition vol. II" (undated but admitted to be prior art).

* cited by examiner

*Primary Examiner*—Henry Bennett
*Assistant Examiner*—Josiah C. Cocks
(74) *Attorney, Agent, or Firm*—Waddey & Patterson; Lucian Wayne Beavers

(57) ABSTRACT

A burner apparatus includes a foraminous burner surface having a multitude of openings through which flames can extend. The burner surface is irregularly shaped so that flames extending from the openings are directed in an irregular pattern whereby eddy currents are generated and effectively disrupt oscillation of the flames to result in reduced noise generation from flame oscillation.

16 Claims, 5 Drawing Sheets

RESONANCE FREE BURNER

BACKGROUND OF THE INVENTION

1. Field of the Invention

The present invention relates generally to the construction of burner for burning a combustible gas mixture.

2. Description of the Prior Art

One common construction for burners for burning a combustible gas mixture utilizes a burner surface made of a foraminous material having a multitude of small holes therein, so that a multitude of very small flames are created on the burner surface. Such prior art burner constructions may utilize either a rigid material upon which the burner surface is defined, or they may utilize a flexible material supported by an interior support structure. These prior art burner constructions typically come in a variety of geometric shapes, such as flat surfaces, cylindrical surfaces, and spherical or semi-spherical surfaces. The burner surface typically is a relatively smooth geometrical surface as defined by the perimeter of the burner construction.

One typical prior art burner construction having a cylindrical shape burner surface constructed from a rigid material is that shown in U.S. Pat. Nos. 4,723,513 and 4,793,800, both to Vallett et al., and both assigned to the assignee of the present invention.

FIGS. 1A, 1B and 1C of the present application schematically illustrate a variety of prior art burner shapes, including a flat burner surface as shown in FIG. 1A, a cylindrical burner surface as shown in FIG. 1B, and a semi-spherical burner surface as shown in FIG. 1C.

One problem which is sometimes encountered with the prior art burner constructions is an excessive noise level which is created when the burner is in operation. There has long been a need for improved burner construction which would eliminate or greatly reduce the noise level inherent in operating a burner.

SUMMARY OF THE INVENTION

A burner apparatus is provided for burning a gas and air mixture. The apparatus includes a foraminous burner surface having a multitude of openings through which flames can extend. The burner surface is irregularly shaped so that flames extending from the openings are directed in an irregular pattern.

The irregular shape of the burner surface causes the irregular pattern of flames to generate eddy currents across the burner surface, which currents effectively disrupt oscillation of the flames thereby reducing noise resulting from the flame oscillation.

The irregular shaped foraminous burner surface may be constructed of either a rigid material or of a flexible material supported from a support structure.

In one preferred embodiment, the irregular shaped burner surface provides an increased burner surface area of at least 10% as compared to a regularly shaped burner surface having the same perimeter dimensions. More preferably, the burner surface area is increased in the range of 10 to 20%.

In one embodiment, the burner apparatus is cylindrical in shape and includes a cylindrical support structure upon which is received a flexible tubular sock having a fully extended length greater than the length of the support structure, so that the sock is wrinkled when it is placed upon the support structure.

A method is provided of operating a burner constructed as described above. An irregular shaped burner surface is provided. A combustible gas mixture is supplied to the burner at a rate such that a plurality of flames extend through the openings of the burner surface. The flames are directed in an irregular pattern by means of the irregular shaped burner surface. Eddy currents are generated, thus disrupting oscillation of the flames, and reducing noise resulting from flame oscillation.

The invention also includes methods of manufacturing burners, including forming an irregularly shaped burner surface from a foraminous material.

It is therefore an object of the present invention to provide improved burner apparatus and methods for operating and manufacturing the same.

Another object of the invention is the provision of burners which operate much more quietly than traditional burners.

Still another object of the present invention is the provision of a burner having an irregular shaped burner surface sufficient to generate eddy currents across the burner surface and effectively disrupt oscillation of flames from the burner surface.

And another object of the present invention is the provision of improved burner construction utilizing flexible heat resistant materials supported from an interior support structure.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 3 shows side-by-side a cylindrical support structure having a first length, and a flexible outer sock having an extended length greater than the first length.

FIG. 4 shows the sock of FIG. 3 partially installed upon the cylindrical support surface of FIG. 3.

FIG. 5 illustrates the sock of FIG. 3 fully installed upon the cylindrical support surface of FIG. 3 so that the sock creates an irregular shaped cylindrical burner surface area.

DETAILED DESCRIPTION OF THE PREFERRED EMBODIMENT

Sound is created by any cyclical pressure variation in an elastic medium such as a gas, liquid or solid, that is perceived by the human ear. The audible frequency for most humans is the range of 10 Hz to 16 KHz.

In a burner, sudden, rhythmic expansion and contraction of hot gases in an oscillating flame front can generate sound. The "flame front" is defined as the leading edge of the flame, that is the place where combustion stops and becomes hot exhaust product. In such an oscillating system, the flame front acts similarly to a speaker diaphragm. So, just as with a speaker diaphragm, the sound intensity increases as the area of the burner media or "diaphragm" increases.

Figure 1A:
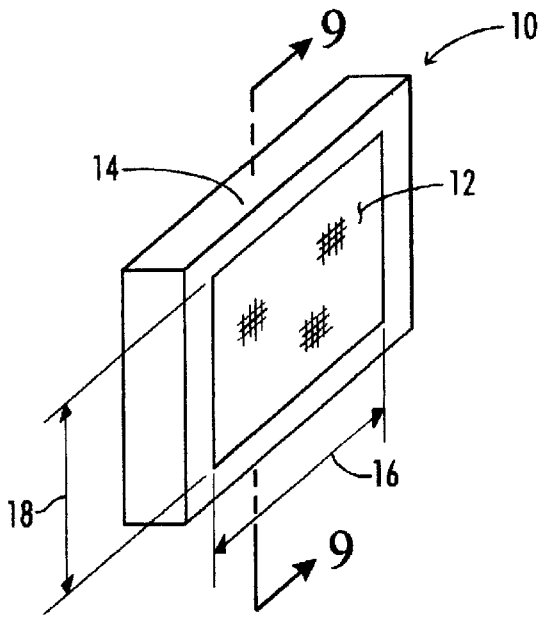
FIG. 1A (PRIOR ART)
FIG. 1A is a perspective view of a prior art burner having a flat burner surface.

FIG. 1A shows for example a conventional prior art burner 10 having a substantially flat, rectangular burner surface 12 contained within a housing 14. The burner surface 12 has a perimeter defined by a length 16 and a width 18.

The materials of construction of the burner surface 12 may either be a rigid material or a flexible heat resistant material.

Figure 9:
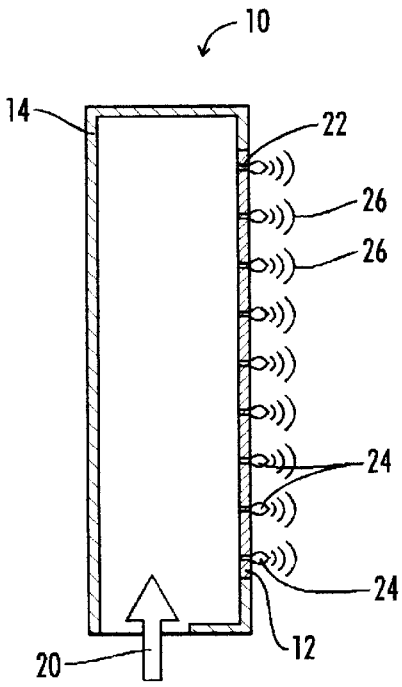
FIG. 9 (PRIOR ART)
FIG. 9 is a schematic illustration of a typical prior art burner having a flat burner surface, taken along line 9—9 of FIG. 1A, and it schematically illustrates a plurality of flame fronts which create a resonance interaction.

FIG. 9 is a schematic sectioned elevation view of the prior art burner of FIG. 1A. The housing 14 receives a mixture of combustion air and gas 20 which then exits the burner surface 12 through a plurality of small openings 22 defined through the foraminous material making up the burner surface 12.

As schematically illustrated in FIG. 9, a tiny flame 24 extends from the burner surface 12 through each of the openings 22. During certain operating ranges of the burner 10, the flames 24 will pulse in a resonant fashion, and each tiny flame sends out a pattern of sound waves 26. If the flames begin to pulse in a resonant fashion, the pattern of sounds waves 26 will re-enforce each other thus resulting in an unacceptably loud noise level being generated by the burner 10.

Figure 1B:
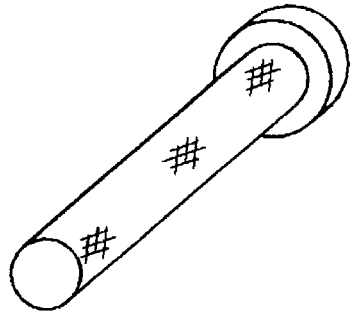
FIG. 1B (PRIOR ART)
FIG. 1B is a perspective view of a prior art burner having a cylindrical burner surface.
Figure 1C:
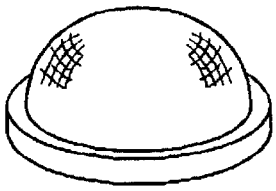
FIG. 1C (PRIOR ART)
FIG. 1C is a perspective view of a prior art burner having a semi-spherical burner surface.

It will be appreciated that FIG. 9 is schematic in form, and that the principal illustrated thereby can result with any prior art burner shape, including for further example the cylindrical shape of FIG. 1B or the semi-spherical shape of FIG. 1C, or any other shape wherein there is a relatively smooth burner surface including a multitude of similarly situated and similarly oriented openings so that a mutually re-enforcing sound wave pattern may be set up at certain operating ranges of the burner. Particularly, at high heat output operation of such a burner, when the combustible gas mixture 20 is being provided at high flow rates, such a burner is capable of generating extremely loud noise levels. These noises typically are of a high frequency "whining" or "whistling" nature which is so obtrusive that it can make the product unacceptable to consumers.

In dealing with noises of any type, including the burner noise of the type just described, the designer can provide means to absorb it, or can move the noise source away from a person whom it might disturb, or the designer can stop the source of the noise. The preferable manner of solving any such noise problem is to eliminate the source of the noise, and this is particularly true with many burners which must be located in areas inhabited by operating personnel.

There are a number of variables that can contribute to such oscillatory flame noise. These variables include, but are not limited to, the type of fuel used, the burner firing rate, the burner size and shape, the firing intensity per unit area, the pressure drop across the burner, the flame shape and size, the fuel to air ratio, the fuel to air mixedness, and the aerodynamics of the combustion chamber.

Figure 10:
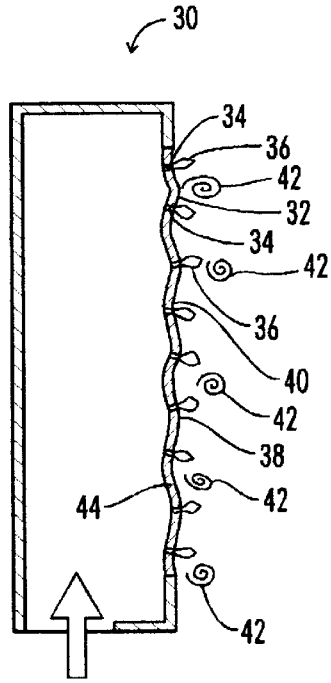
FIG. 10 is a schematic cross-section illustration of a generally flat burner construction in accordance with the present invention, taken along line 10—10 of FIG. 2A, having an irregular shape generally flat burner surface, and illustrating the randomly oriented directions of the flames and the eddy currents created thereby which break up the resonance interaction between flame fronts.

We have discovered that the source of such oscillatory burner noise can be eliminated or very greatly reduced by the use of a burner construction like that schematically illustrated in FIG. 10.

FIG. 10 illustrates a generally flat burner constructed in accordance with the present invention and identified by the number 30. The burner 30 is also shown in FIG. 2A.

Figure 2A:
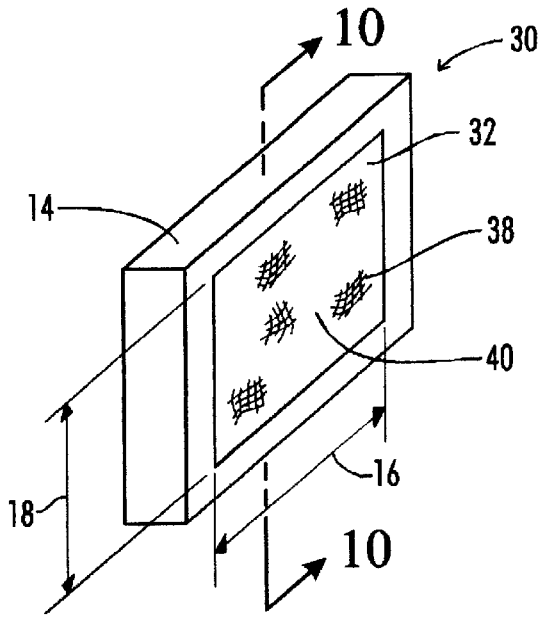
FIG. 2A is a perspective view of a burner having a perimeter and general geometry like that of the prior art flat burner of FIG. 1A, but having an irregular shaped burner surface in accordance with the present invention.

The inventive burner 30 of FIGS. 2A and 10 include the foraminous burner surface 32 having a multitude of openings 34 through which flames such as 36 can extend. The burner surface 32, however, is irregularly shaped thus comprising hills 38 and valleys 40, so that the flames 36 extend from the openings 34 in an irregular pattern, and so that the flames have varying exit velocities. This irregular pattern and varying exit velocities create eddy currents schematically illustrated at 42 are generated across the burner surface 32 and are effective to disrupt oscillation of the flames 36 whereby noise resulting from flame oscillation is reduced, because the various small sound waves generated by each individual flame cannot re-enforce each other.

An eddy current is a current moving contrary to the direction of the main current, especially in a circular motion. These eddys are of adequate magnitude to effectively disrupt a rhythmic flame pattern or oscillation to prevent the same from developing, thereby preventing objectionable noise.

Noise is further reduced by the fact that there is an increase in burner surface area, thus leading to a corresponding reduction in firing intensity per unit area. There is generally a noise reduction associated with reduced firing intensity per unit area. The provision of the irregular shaped burner surface area effectively increases the burner diameter in certain areas, which increase diameter translates to additional surface area in the same overall burner length.

The burner surface 32 is defined upon a layer of burner material 44. In the embodiment illustrated in FIG. 10, the burner material 44 is a rigid material and is self-supporting. As is further described below, the burner material 44 may also be a flexible material which is supported upon an internal support structure, like the cylindrical internal support structure illustrated in FIGS. 3, 4 and 5.

As previously noted, FIGS. 1B and 1C show two further examples of other geometric shapes of prior art burner construction. FIG. 1B shows a prior art cylindrical burner construction and FIG. 1C shows a prior art semi-spherical burner construction.

Figure 2B:
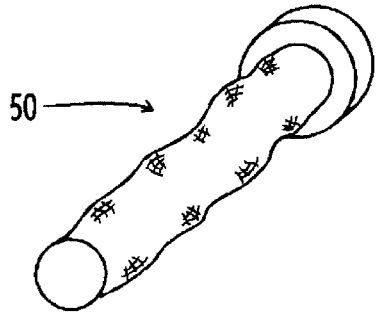
FIG. 2B is a perspective view of a generally cylindrical burner having perimeter dimensions similar to that of the prior art burner of FIG. 1B, but having an irregular shaped burner surface in accordance with the present invention.
Figure 2C:
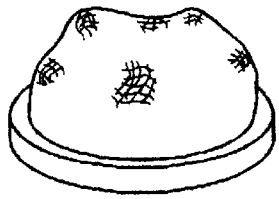
FIG. 2C is a perspective view of a generally semi-spherical burner having perimeter dimensions similar to that of the prior art burner of FIG. 1C, but having an irregular shaped burner surface in accordance with the present invention.

FIGS. 2B and 2C show generally cylindrical and generally semi-spherical shaped burners incorporating the present invention whereby the burner surface is irregularly shaped in a manner analogous to that described above with regard to the flat burner of FIG. 2A and FIG. 10. In either case, the layer of material defining the burner surface may either be a rigid material which is self-supporting, or it may be a flexible material supported on an internal support structure.

The cylindrical burner in accordance with the present invention as shown in FIG. 2B is generally identified by the numeral 50.

A cylindrical burner 50 is particularly well adapted for use in a burner construction like that of U.S. Pat. Nos. 4,723,513 and 4,793,800 to Vallett et al., the details of which are incorporated herein by reference. Such a cylindrical burner is concentrically disposed within a circular array of fin tubes which comprise a water heating system. A generally cylindrical shaped burner 50 constructed from rigid foraminous materials could for example be especially well utilized with a system like that of either of the aforementioned Vallett patents, which systems are designed for use at a relatively constant burner rate involving a relatively constant flow rate of combustible gas mixture thereto.

On the other hand, some burner systems are constructed for use over a wide range of flow rates, and thus may utilize a flexible burner material. Such a system is shown for example in pending U.S. patent application Ser. No. 09/497,399 of Bodnar et al., and assigned to the assignee of the present invention, the details of which are incorporated herein by reference. The system of the Bodnar et al. application operates over a wide range of burner flow rates, and utilizes a generally cylindrical burner having a burner surface constructed from a flexible heat resistant material.

The following specific examples and test data relate to a generally cylindrical shaped burner 50 constructed in accordance with the present invention to have an irregular burner surface as shown on FIG. 2B. These generally cylindrical shaped burners are particularly adapted for use in a system like that of the pending Bodnar et al. application.

Figure 3:
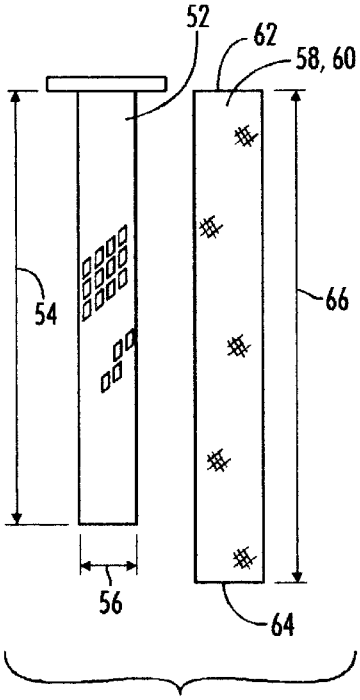
FIGS. 3, 4 and 5 are a consecutive series of illustrations, illustrating the method of manufacturing the burner of the present invention, as applied to a generally cylindrical burner construction.
Figure 4:
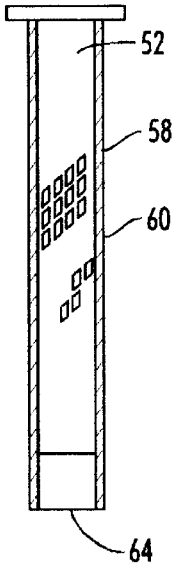
Figure 5:
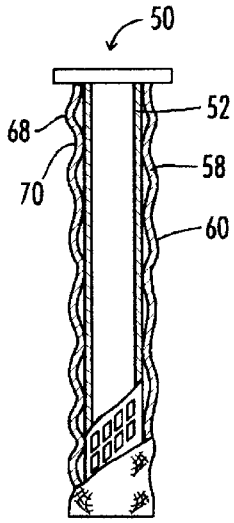
Figure 6:
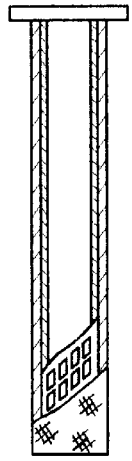
FIG. 6 (PRIOR ART)
FIG. 6 is a view similar to FIG. 5 contrasting the construction of a prior art cylindrical burner like that of FIG. 1B, to the cylindrical burner of the present invention shown in FIG. 2B and FIG. 5.

FIGS. 3, 4 and 5 comprise a sequential series of illustrations showing the steps of constructing the generally cylindrical shaped burner in accordance with the present invention. The burner 50 includes a generally cylindrical support structure 52 to be constructed of a rigid material, such as for example stainless steel expanded metal sheet. The support structure 52 has a length 54 and a diameter 56 thus defining a support surface area which in the case of the cylindrical surface 52 will be equal to the circumference of the cylinder times the length 54.

The burner 50 further includes exterior layer 58 of flexible porous material covering the support surface 52 and defining a burner surface 60. The exterior layer is formed in the shape of a tubular sock having first and second ends 62 and 64 defining a fully extended length 66 therebetween. The second end 64 may either be open, in which case the burner will be closed by an end cap (not shown), or the second end 64 of sock 58 may be closed by an additional portion of the porous flexible material.

The cylindrical sock 58 is slightly larger in diameter than the support structure 52, so that the sock 58 may be received over the support structure 52 in a manner shown in the intermediate step illustrated in FIG. 4.

The exterior layer of sock 58 includes an effective exterior surface area equal to the fully extended length 66 times the circumference of the sock 58. Thus, it will be seen that the sock 58 has an exterior surface area which substantially exceeds that of the support structure 52, generally in proportion to the amount by which the length 66 of sock 58 exceeds the length 54 of support structure 52.

To construct the burner 50, the sock 58 is pushed up onto the support structure 52 until its end 64 and 66 are generally coincident with the ends of the tubular support structure 58 as shown in FIG. 5. Then the sock 58 is attached to the support structure 52, such as for example by crush welding of the sock material 58 to the support structure 52.

This causes the sock material 58 to wrinkle thus forming an irregular exterior surface 60 as shown in FIG. 5, which irregular exterior surface is comprised of hills 68 and valleys 70 analogous to the hills and valleys 38 and 40 described above with regard to the generally flat burner of FIG. 2A and FIG. 10.

A series of examples of generally cylindrical shaped burners in accordance with the present invention were constructed and tested. The examples included burners constructed to operate at 1.5 million BTU/hr, 1.7 million BTU/hr and 2.0 million BTU/hr. These burners were constructed for use with a water heating system like that of Bodnar et al., U.S. patent application Ser. No. 09/497,399. The amount of excess flexible burner material was changed for each example until all objectionable noise was eliminated. It will be understood that it is desirable to use the least amount of additional material possible, while still achieving the desired noise reduction, in order to minimize the cost of the burner.

The following Table I describes the final burner parameters for successful examples of burners operating at 1.5, 1.7 and 2.0 million BTU/hr, respectively. The first column identifies the BTU rating of the example. The second column identifies the burner length and burner surface loading of a comparable BTU rated smooth cylindrical burner like that described in the Bodnar et al. application. The third column describes the flexible material and the effective surface loading of the burner as constructed in accordance with the present invention. The fourth column states on a percentage basis the increased flexible material utilized in the exterior layer. The fifth column summarizes the optimal range of excess or increased burner surface area derived from these examples, and the range of burner loading derived from these examples.

TABLE I

| Model (Million BTU) | Original Burner Length/ Loading | New Burner Length/ Loading | Increased Material Percentage | Optimal Range of Excess and Loading |
|---|---|---|---|---|
| 1.5 | 30"/4000BTU/in$^2$ | 34"/3500 BTU/in$^2$ | 13% | 10%–20%/ |
| 1.7 | 34"/4000BTU/in$^2$ | 37.5"/3625 BTU/in$^2$ | 10% | 3300–3700 |
| 2.0 | 40"/4000BTU/in$^2$ | 47.5"/3370 BTU/in$^2$ | 19% | |

As seen in the examples of Table I, the optimal increased burner surface area generally falls within the range of 10 to 20%. The optimal burner loading falls within the range of 3300 to 3700 BTU/in$^2$.

It is noted that the 2.0 million BTU/hr burner example required more excess material than the lower BTU burner before the oscillation was disrupted completely. Initially, a prototype of the 2.0 million BTU/hr burner was made with approximately 13% excess material, and a hint of objectionable noise was still evident. By increasing the excess material to 19%, the noise problem was solved entirely for the 2.0 million BTU/hr burner.

It is further significant to note, that there was no degradation whatsoever in burner performance when changing from the prior cylindrical burner construction like that of the Bodnar et al. application, to the inventive cylindrical burner construction utilizing the irregular burner surface of the present invention. The following data are taken from operation of the 2.0 million BTU per unit, and these data show no significant increase or change in emissions readings for the burner.

TABLE II

| % Fire | Air ΔP/Gas ΔP (before) | Air ΔP/Gas ΔP (after) | $CO^2$/CO (before) | $CO^2$/CO (after) |
|---|---|---|---|---|
| 100 | 3.20/3.25 "w.c. | 3.45/3.45 "w.c. | 9.5%/72 ppm | 9.6%/82 ppm |
| 50 | 1.45/1.50 "w.c. | 1.55/1.55 "w.c. | 9.4%/44 ppm | 9.7%/56 ppm |
| 25 | 0.15/0.20 "w.c. | 0.15/0.20 "w.c. | 9.0%/14 ppm | * 10.5%/ 14 ppm |

* Note: high $CO^2$ of 10.5% is caused by gas valve bias setting and not due to burner change.

The exterior flexible sock is preferably constructed of a material such as the NIT 100S Metal Fibre Burner products available from AcoTech Corp. of Marietta Ga. These materials comprise a woven fabric of metal fibers having a thickness of approximately ⅛". Other suitable flexible materials include sintered metal fiber material also available from AcoTech. These metal fiber materials available from AcoTech are constructed from an alloy known as Fecralloy.

Other suitable flexible heat resistant materials include ceramic weaves and other alloy meshes. Also, a fabric constructed of rock fiber could be utilized.

One suitable rigid material is stainless steel expandable metal bent into an irregular shapes comparable to the shapes illustrated in the present application. Another suitable rigid material would be a porous ceramic material formed in the irregular shape illustrated in the present application.

Figure 7:
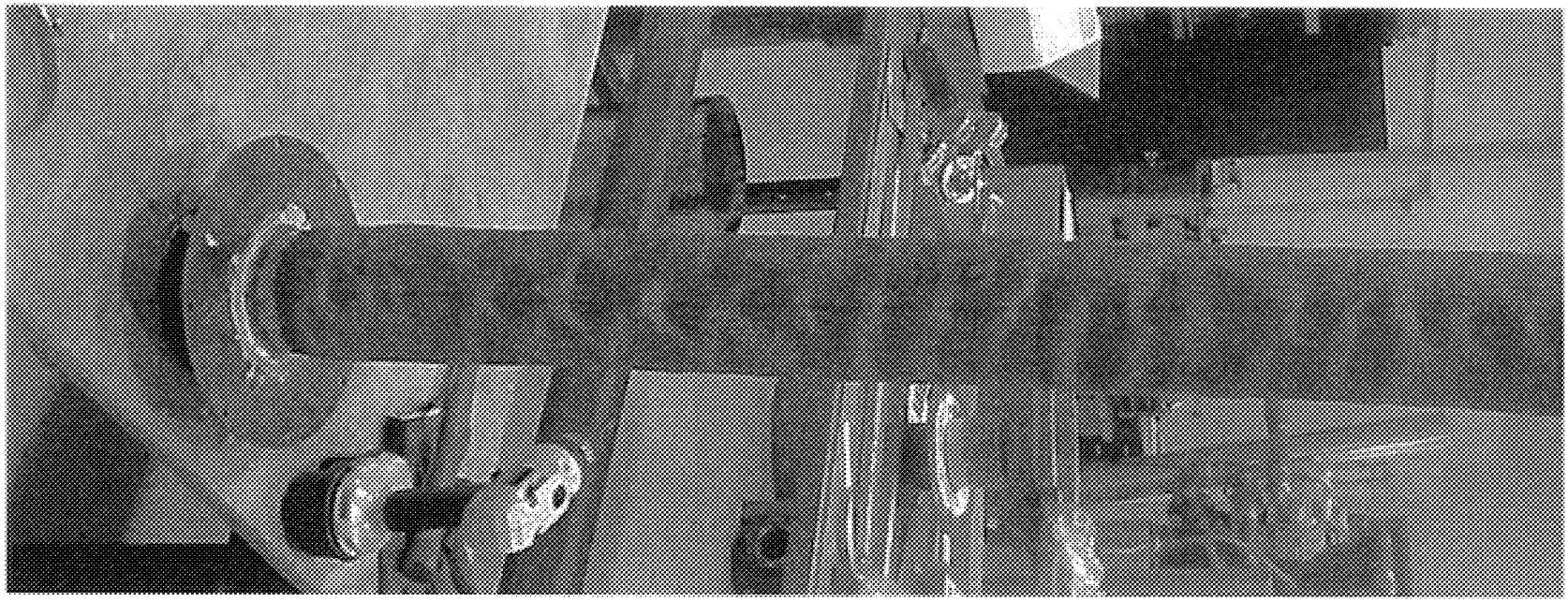
FIG. 7 is a photographic illustration of one example of the irregular shaped burner surface on a cylindrical burner structure in accordance with the present invention.
Figure 8:
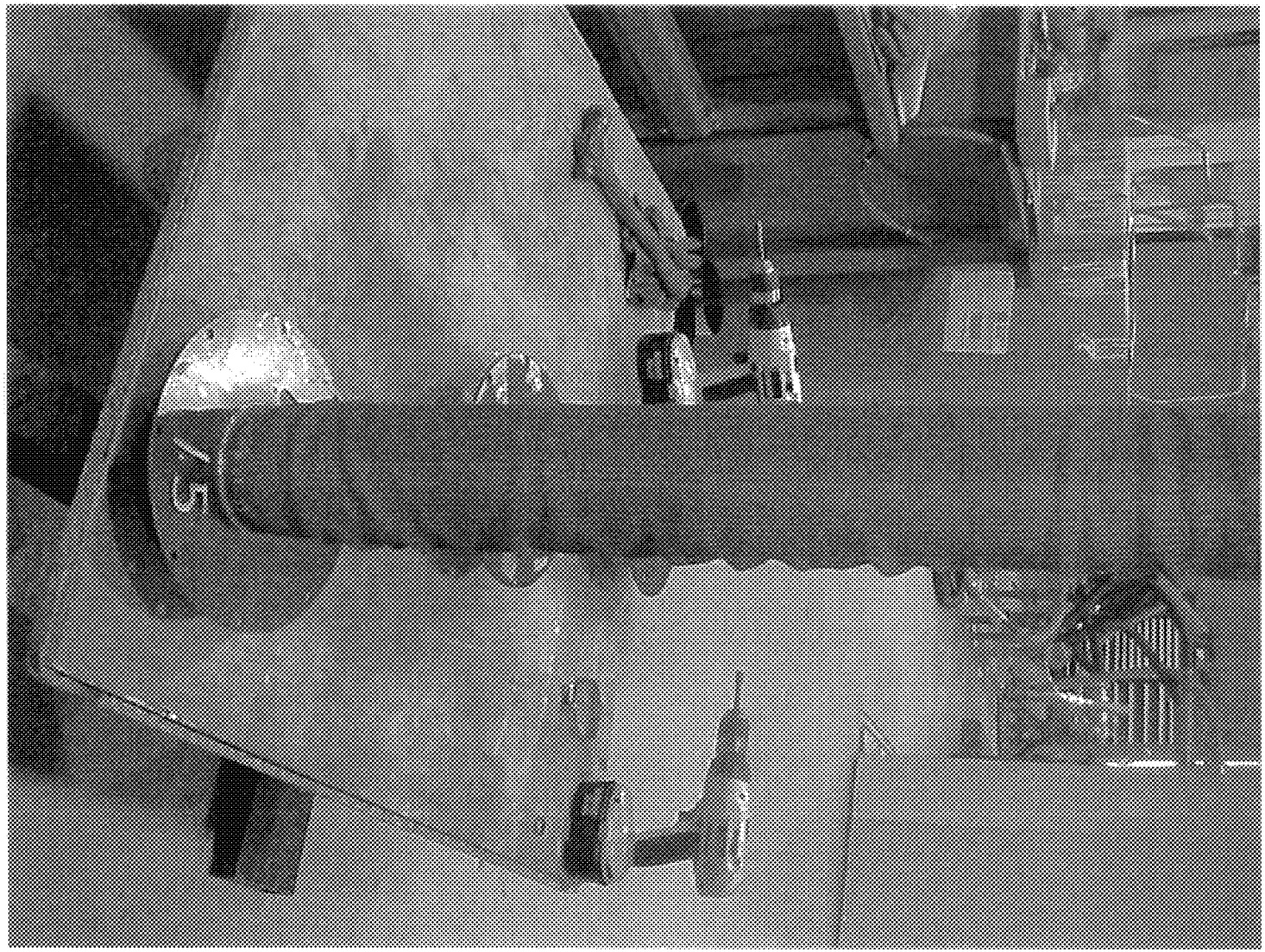
FIG. 8 is a photographic illustration of another example of an irregular shaped burner surface on a cylindrical burner structure in accordance with the present invention.

FIGS. 7 and 8 are photographic illustrations of two of the examples of cylindrical burners described above. The burner shown in FIG. 7 is the 2.0 Million BTU/hr model described in Table I. The example illustrated in FIG. 8 is the 1.5 million BTU/hr example described in Table I above.

As seen in the examples of FIGS. 7 and 8, the burner surface is wrinkled in a generally random pattern. It will be understood, however, that it would be possible to provide an irregular bumpy surface having perhaps a regular pattern of bumps, but still providing a sufficient disruption of the surface so that noise would be eliminated. Thus, it is conceivable to have a regular pattern of irregular surface features, which result in the pattern of flames creating eddy currents which will disrupt any resonant interaction between the adjacent flames, and thus, which will accomplish the desired results of reducing noise.

In assembling the burners of either FIGS. 7 and 8, in the manner illustrated in the sequential series of drawings of FIGS. 3, 4 and 5, the sock can be moved onto the cylindrical support structure by hand, and the flexible material can be manipulated by hand to generally spread the wrinkles over the burner surface area.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A burner apparatus for burning a gas and air mixture, comprising:

a foraminous burner surface having a multitude of openings through which flames can extend, the burner surface being irregularly shaped so that flames extending from the openings are directed in an irregular pattern;

wherein the burner surface is constructed of a flexible material and the apparatus further includes a support structure supporting the flexible material, wherein the flexible material is wrinkled in a random pattern.

2. The apparatus of claim 1, wherein the irregular shape of the burner surface is sufficient to generate eddy currents across the burner surface and effectively disrupt oscillation of the flames, whereby noise resulting from flame oscillation is reduced.

3. The apparatus of claim 1, wherein:

the irregular shape burner surface provides an increased burner surface area as compared to a generally smooth burner surface having the same perimeter dimensions.

4. The apparatus of claim 3, wherein the burner surface area is increased by at least 10%.

5. The apparatus of claim 3, wherein the burner surface area is increased in the range of 10 to 20%.

6. A burner apparatus, comprising:

a support structure defining a support surface area; and an exterior layer of flexible porous material covering the support surface area and defining a burner surface, the exterior layer having an exterior layer area in excess of the support surface area, and the exterior layer being wrinkled to provide an irregular shaped burner surface, so that the support structure underlies substantially the porous material without being co-extensive with the irregular shape of the burner surface.

7. The apparatus of claim 6, wherein:

the support structure is tubular; and the exterior layer includes a tubular sock of the flexible porous material.

8. The apparatus of claim 7, wherein:

the support structure has a length and first and second ends and the support structure extends from its first end to its second end; and the tubular sock has a fully extended length greater than the length of the support structure, the sock having first and second ends coincident with the first and second ends of the tubular support structure.

9. A burner apparatus, comprising:

a cylindrical support structure having a continuous length defined between first and second ends of the cylindrical support structure; and an exterior sock of flexible porous heat resistant material received about the cylindrical support structure, the sock having first and second ends and having an extended sock length defined between the first and second ends, the first and second ends of the sock being attached to the support structure and defining an installed sock length there between less than the extended length of the sock, so that the installed sock is wrinkled between its first and second ends.

10. The apparatus of claim 9, wherein:

the extended sock length exceeds the installed sock length by at least 10%.

11. The apparatus of claim 9, wherein:

the extended sock length exceeds the installed sock length by in the range of 10% to 20%.

12. A method of manufacturing a burner, comprising:

providing a supporting structure; and forming an irregularly shaped burner surface from a flexible foraminous material having a plurality of openings through which flames can extend, said forming including placing the flexible material over the supporting structure and wrinkling the flexible material, so that the supporting structure underlies substantially the entire flexible material.

13. The method of claim 12, further comprising:

providing said flexible material in an amount by area exceeding a covered area of the support structure by at least 10%.

14. The method of claim 12, further comprising:

providing said flexible material in an amount by area exceeding a covered area of the support structure by in the range of 10% to 20%.

15. The method of claim 12, wherein:

the wrinkling step is performed by manipulating the flexible material by hand to spread the wrinkles over the burner surface.

16. The method of claim 12, wherein:

the support structure is cylindrical having a support length, the flexible material is shaped as a cylindrical sock having two ends and having an extended length greater than the support length; and the forming step includes:

placing the entire sock about the support structure by wrinkling the sock; and attaching the two ends of the sock to the support structure to hold the sock in place.

* * * * *